United States Patent [19]

Rossi

[11] Patent Number: 4,709,745

[45] Date of Patent: Dec. 1, 1987

[54] PROCESS AND APPARATUS FOR MAKING THIN STEEL SLABS

[76] Inventor: Irving Rossi, Dunross Farm, James St., Morristown, N.J. 07960

[21] Appl. No.: 916,831

[22] Filed: Oct. 9, 1986

Related U.S. Application Data

[63] Continuation of Ser. No. 718,179, Apr. 1, 1985, abandoned, which is a continuation-in-part of Ser. No. 612,048, May 18, 1984, abandoned.

[51] Int. Cl.[4] ..... B22D 11/00; B22D 11/128

[52] U.S. Cl. ..... 164/484; 164/418; 164/441; 164/485

[58] Field of Search ..... 164/418, 439, 441, 447, 164/459, 483, 484, 485, 488, 489

[56] References Cited

U.S. PATENT DOCUMENTS

| | | | |
|---|---|---|---|
| 2,363,695 | 11/1944 | Ruppik | 164/81 |
| 2,565,959 | 8/1951 | Francis | 164/442 |
| 3,358,744 | 12/1967 | Rossi | 164/441 |
| 3,391,725 | 7/1968 | Rossi | 164/484 |
| 3,399,716 | 9/1968 | Rossi | 164/486 |
| 3,766,962 | 10/1973 | Rossi | 164/442 |
| 3,766,963 | 10/1973 | Rossi | 164/486 |
| 3,812,901 | 9/1974 | Stewart | 164/484 |

FOREIGN PATENT DOCUMENTS

| | | |
|---|---|---|
| 53-138925 | 12/1978 | Japan . |
| 57-28655 | 2/1982 | Japan . |
| 57-202947 | 12/1982 | Japan . |
| 58-41656 | 10/1983 | Japan . |
| 58-77748 | 11/1983 | Japan . |
| 1457263 | 12/1976 | United Kingdom . |
| 916067 | 3/1982 | U.S.S.R. . |

*Primary Examiner*—Gene P. Crosby
*Assistant Examiner*—Richard K. Seidel

[57] ABSTRACT

A process and apparatus for the continuous casting of thin steel slabs in which a chilled surface submerged below the surface of a pool of molten metal is exposed to molten metal to cause an embryo cast strand to be formed thereon and in which the embryo strand is withdrawn upwardly continuously over a continuation of said chilled surface. The strand may be moved directly from withdrawal rolls to reshaping rollers while still retaining sufficient residual heat to permit reshaping without reheating.

8 Claims, 4 Drawing Figures

PROCESS AND APPARATUS FOR MAKING THIN STEEL SLABS

BACKGROUND OF THE INVENTION

This application is a continuation of application Ser. No. 718,179, filed Apr. 1, 1985 now abandoned which in turn was a continuation-in-part of my copending application Ser. No. 612,048, filed May 18, 1984 now abandoned.

Heretofore, processes and machines for the continuous casting of metal strands have fallen, for the most part, into two different groups. The first, and historically the earliest group, may be referred to as the vertical group in which the molten metal to be cast is poured continuously into the open upper end of a substantially vertically disposed mold passage of a chilled mold in which a continuous strand consisting of a solidified shell surrounding a molten core is formed as heat is withdrawn through the chilled walls of the mold passage. The embryo cast strand so formed is withdrawn downwardly continuously from the open lower end of the mold passage where it enters a secondary cooling zone in which it is subjected to further cooling and solidification by direct application of cooling fluid to the solidified surface. The Junghaus U.S. Pat. Nos. 2,135,183 and 2,135,184 are representative of the earliest commercially successful continuous casting processes of this group.

In this group, in order to reduce the overall height of the machines, it has been common practice to cause the downwardly moving strand to be curved, either by the use of a curved mold passage, or otherwise, so that the cast strand moves along a curved path through the secondary cooling zone. It is then straightened to cause it to move on in a substantially horizontal path in which it may be cut into manageable lengths. Within the secondary cooling zone it has been customary to support the strand by a structure sometimes referred to as a roller apron in which the surfaces of the strand are engaged by a series of pairs of rollers between which the cooling water is applied to the strand. Such roller aprons are cumbersome and expensive to build and maintain.

Virtually all commecial installations of continuous casting machines are of the vertical type above described.

The second group may be referred to as the horizontal group because the mold passage through the chilled mold is substantially horizontally disposed. However, the theoretical advantages of the horizontally disposed mold passage have been outweighed by practical difficulties which have been encountered in their use, particularly in feeding the molten metal into the mold passage. Machines and processes of this group have found very little commercial use.

It is an object of the present invention to provide a different approach to the problem of casting metals continuously by departing from the conventional methods in which molten metal is introduced into a mold passage that extends either vertically or horizontally through a chilled mold and an embryo cast strand is withdrawn from the mold passage either downwardly or horizontally therefrom.

I propose to depart from these known methods by forming an embryo cast strand on a chilled surface submerged within a pool of molten steel, and withdrawing the strand upwardly along a continuation of said chilled surface extending above the surface of the pool to continue and complete the solidification process.

It is a further object of the invention to reform the strand as it moves off the chilled surface while it retains sufficient residual heat to be reformable, thereby eliminating any need to reheat the strand.

SUMMARY OF THE INVENTION

The invention is especially adapted to the manufacture of relatively thin steel slabs of one-half to one inch in thickness, and will be described more particularly hereinafter as applied thereto.

According to the present invention, I propose to expose molten steel within a pool thereof to a transversely flat chilled surface having a first portion submerged below the surface of the pool to form an embryo cast strand thereon, and to withdraw the embryo cast strand upwardly along a second portion of said chilled surface forming a continuation of said submerged surface and located above the surface of the pool, at a rate to permit withdrawal of sufficient heat through said flat submerged surface to form on said surface a partially solidified strand of the desired thickness and weight thereon.

I also propose to provide means resistant to heat transfer extending at least along the side edges of the submerged portion of the chilled surface and forming vertical walls projecting above said surface to restrict heat transfer from the strand except through said chilled surface.

I also propose that the first portion of said chilled surface, i.e., the submerged portion thereof, be curved convexly, longitudinally to form a short arc of a circle, and that the lower end of the arc be located substantially perpendicularly to the horizontal surface of the molten metal pool so that the embryo cast strand will move along the submerged portion of the chilled surface in a substantially vertical direction while it is accumulating metal from the pool and until it emerges from the pool.

I also propose that the second portion of said chilled surface be curved convexly to form an arc of a circle of the same radius as that of the submergd arc so that as the embryo strand moves from the submerged portion onto and along the second portion it is not subjected to bending or other stresses as it proceeds along said surfaces and during the time when the crystal structure of the strand is being formed and solidified by withdrawal of heat through said chilled surfaces.

I also propose to cause the solidified strand to move directly from the chilled surface to pass between forming rollers while it retains sufficient residual heat to be easily deformable without need to reheat the strand, thus making possible considerable saving in the cost of the product.

Preferably, the curved chilled mold surfaces may extend through a total circular arc of between 45° and 75° so that the strand may leave the second portion of the chilled surface moving toward withdrawal rolls and a work station such as a rolling mill, for example The quantity of heat withdrawn from the strand is controlled to permit the strand to retain sufficient residual heat to be reshaped by rolling without reheating.

DESCRIPTION OF THE DRAWINGS

A preferred embodiment of the invention selected for purposes of illustration is shown in the accompanying drawings, in which.

DESCRIPTION OF THE PREFERRED EMBODIMENT

Figure 1:
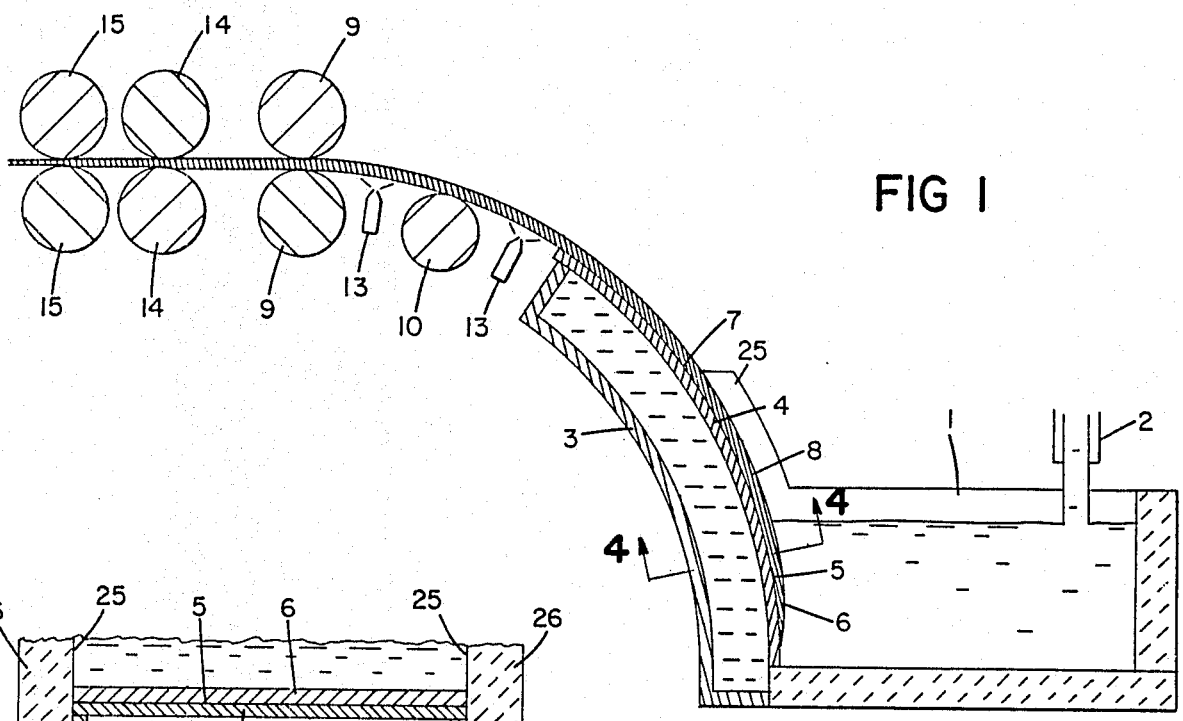
FIG. 1 is a semi-diagramatic vertical cross-section showing the process and apparatus in normal operating position.
Figure 4:
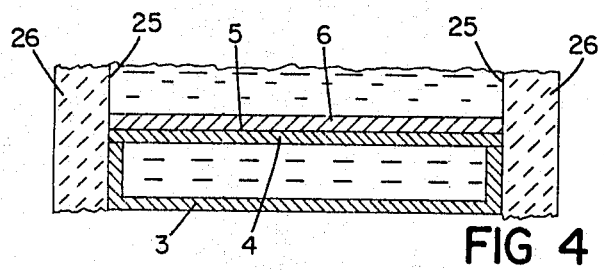
FIG. 4 is a cross section on the line 4–4 of FIG. 1 showing guide strips to restrain lateral heat transfer from the chilled mold surfaces.

Referring to FIG. 1 of the drawings, the pool of molten metal to be cast may be stored in a suitable tundish or reservoir 1 of refractory material to which molten metal may be supplied in any suitable manner as through a spout 2. The flow of metal to the reservoir may be controlled in any suitable manner; i.e., either manually or automatically by known means responsive to the level of molten metal in the reservoir; i.e., to increase the flow of metal into the reservoir when the level tends to fall below a predetermined level, or to decrease the flow of metal when the level rises above the predetermined level.

At one side of the reservoir is a water cooled mold 3 having a transversely flat thermally conductive wall 4, preferably of copper, forming a flat chilled mold surface having a lower portion 5 that extends to the bottom of said reservoir and submerged in the molten metal therein. Thus the molten metal mold is exposed to the chilled surface 5 so that heat may be withdrawn through said surface to cause an embryo cast strand 6 to begin to be formed thereon.

The side edges of the chilled mold wall 4, at least along the submerged portions thereof, abut the vertical walls 25 of guide strips 26 which extend along said edges and project above said chilled surface and restrain and smooth the side edges of the cast strand. However, it is important that heat be withdrawn only downwardly through the chilled surface of mold wall 4 and that it not be withdrawn laterally from the strand through the strips 26. Therefore, they are preferably made of materials which are resistant to heat transfer, such as refractory materials, for example. Since the surfaces of the submerged portions of the strips 26 are exposed to the molten metal in the pool and will be heated thereby, there will be little or no tendency for heat transfer through them from the strand, but if desired, electrical heating elements may be embedded in the strips, particularly those located above the surface of the pool.

Alternatively, however, said strips may be made of metal, such as steel, for example, in which case the strips, even though submerged, may have heating elements embedded therein to maintain the strips at a temperature sufficient to prevent heat transfer laterally from the strand.

In this connection it is to be noted that the embryo casts strand will be completely formed when it reaches the level of the metal in the pool. That is, no metal will be added to the strand above the pool level, although previously adhered metal in liquid or partially solidified state will be solidified subsequently by additional heat transfer as it moves along the second portion of the chilled surface above the pool level.

The strips 26 may be extended along the side edges of the mold wall as far as desired, although, since complete solidification of the strand may occur within a reasonably short distance beyond the pool level, the strips may not be needed along the entire length of the mold wall.

The mold wall 4, although flat transversely, is curved longitudinally to form a circular arc of from 45° to 75°. The lower portion of the chilled surface designated by 5 forms only a short portion of the entire chilled surface of the mold and the lower end of the arc is located substantially perpendicularly to the bottom of the reservoir and to the surface of the molten metal pool. It extends only through an arc of 10° to 20° so that the embryo strand will move along the submerged chilled surface in substantially vertical direction while it is accumulating metal from the pool. Since the two convexly curved surfaces 5 and 7 are formed on the same radius, the embryo cast strand retains its contour as it moves along both portions and is not subjected to bending or other stresses as its crystal structure is being formed and solidified. Bending of the strand is required only as it reaches the withdrawal rolls 9, by which time solidification of the strand will have been completed.

If necessary, the surfaces of the mold wall 4 may be lubricated by methods known in the art.

The mold 3 may be supported in any suitable manner. The portion of the strand 8 between the surface 7 and the withdrawal rolls 9 may be supported by one or more rollers such as roller 10.

Figure 3:
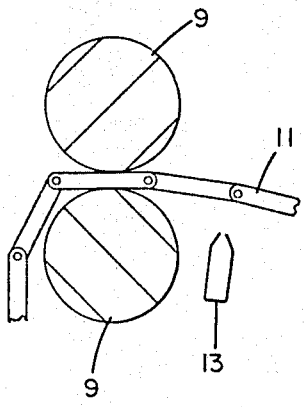
FIG. 3 is a view of the upper portion of the starter apparatus.
Figure 2:
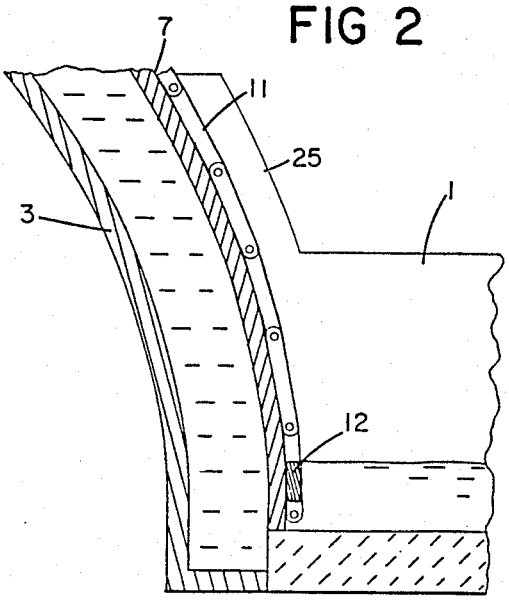
FIG. 2 is a similar view of a portion of the apparatus showing the process in starting position.

At the beginning of the operation, as shown in FIGS. 2 and 3, a plurality of chains 11 may be arranged to extend down along the chilled surfaces 7 and 5 to the bottom of the reservoir 1 to be imbedded in the first of the solidified metal which forms on the surface 5. The other ends of the chains 11 may be extended upwardly over the surface 7 to the withdrawal rolls 9. In the beginning of the operation the level of the molten metal in the reservoir 1 is relatively low indicated in FIG. 3. When sufficient solidified metal has accumulated on the lower end of the chains to form a starter bar 12 extending transversely across the surface 5, the withdrawal rolls 9 may be activated to begin the withdrawal of the starter bar. At the same time the level of molten metal mold is allowed to rise as indicated in FIG. 1 and the embryo cast strand 6 continues to be formed by withdrawal of heat through the surface 5.

As the operation proceeds, the thickness of the cast strand may be determined by adjustment of either or both of two factors: (1) the depth of the molten metal in the pool and (2) the rate of withdrawal of the cast strand. The slower the rate of withdrawal, the greater the thickness of the cast strand. Likewise, the greater the depth of the molten metal in the pool, the greater the thickness of the cast strand. It will be understood that the molten metal will begin to solidify against the chilled surface 5 near the bottom thereof to form the embryo strand 6. The strand will be very thin at first but will thicken gradually as it is withdrawn upwardly along the chilled surface 5 until it reaches its maximum thickness as it emerges from the pool. Thereafter, the strand is cooled additionally as it moves along the continuation 7 of the chilled surface 5. If desired, it may be cooled still further by sprays from nozzles.

However, I propose to control the total quantity of heat withdrawn from the strand 8 through the surfaces 5 and 7 and by the sprays from nozzles 13 before it reaches the withdrawal rolls 9 so that as it leaves the withdrawal rolls 9 it will still contain sufficient residual heat to permit it to be reduced in thickness or otherwise reshaped without reheating. Thus as the strand 8 leaves the withdrawal rolls, it may be moved directly between pairs of rolls 14 and 15 which reduce the thickness of the strand. For example, if the apparatus shown in the drawings is used to form a strand such as a steel slab having a thickness of one inch to one and one-half inches as it leaves the pool, the thickness of the strand could be reduced by rolls 14 and 15 to provide hot rolled sheet steel having a thickness of one quarter inch or less. For this purpose, the forming rolls 14, 15 and the withdrawal rolls 9 may be mounted together as a unit in a supporting structure (not shown) forming part of the supporting structure for the mold.

It will be understood that the invention may be variously modified and embodied within the scope of the subjoined claims.

What is claimed is:

1. A process for the continuous casting of thin steel slabs of uniform transverse thickness which comprises exposing a pool of molten metal to a fixed chilled surface which is flat transversely and curved longitudinally to form a convex arc and which has a first portion submerged within the pool and a second portion extending above and beyond the surface of said pool as a continuation of said first portion, said second portion having a length greater than said first portion withdrawing heat from the molten metal in one direction only through said first portion of said chilled surface while restricting heat transfer from the molten metal along the side edges of said chilled surface to form an embryo flat cast slab thereon which is of uniform thickness across its width, and withdrawing the embryo cast slab continuously along said chilled surface while continuing to withdraw heat from the embryo flat cast slab in one direction only through said chilled surface while restricting heat transfer from the embryo flat cast slab along the side edges fo said slab, at a rate to permit withdrawal of heat through said chilled surface sufficient to cause a flat slab of the desired thickness to be formed thereon.

2. The process claimed in claim 1 in which the submerged portion of said chilled surface extends substantially perpendicularly to the horizontal surface of the pool and the cast slab moves substantially vertically as it is withdrawn.

3. The process claimed in claim 1 in which the thickness of the slab is determined by controlling the rate of withdrawal of the slab.

4. The process claimed in claim 1 in which the thickness of the slab is determined by controlling the depth of molten metal in the pool.

5. The process claimed in claim 1 in which the total quantity of heat withdrawn from the slab is controlled to cause the slab to retain sufficient heat to permit it to be reshaped without reheating after it leaves said surfaces.

6. Apparatus for the continuous casting of metal slabs of uniform transverse thickness, comprising:

a reservoir containing a pool of molten metal, a mold having a mold wall having a fixed transversely flat chilled surface which is curved longitudinally to form a convex arc, said chilled surface having a first portion in said reservoir through which heat is withdrawn from the molten metal in one direction only to form an embryo cast slab thereon, means resistant to heat transfer extending along the side edges of said chilled surface and projecting upwardly above said reservoir to restrict heat transfer from said embryo cast slab except through said chilled surface, said chilled surface having a second portion forming a continuation of said first portion extending above and beyond said reservoir for a length greater than the length of said first portion, and means for withdrawing the embryo cast slab continuously along said chilled surface.

7. Apparatus as claimed in claim 6 in which the lower end of said chilled surface extends substantially vertically.

8. Apparatus as claimed in claim 6 wherein said withdrawing means includes a set of withdrawing rollers in generally horizontal alignment with the upper end of said chilled surface and further including a set of reshaping rollers in generally horizontal alignment with said set of withdrawing rollers for reshaping said cast slab by passing said slab through said reshaping rollers after said slab leaves said withdrawing rollers and while said slab still retains sufficient residual heat to permit reshaping without reheating.

* * * * *